US005364092A

United States Patent [19]

Riepe et al.

[11] Patent Number: 5,364,092

[45] Date of Patent: Nov. 15, 1994

[54] BASKETBALL SHOOTING ACCURACY PRACTICE RIM

[76] Inventors: Addison E. Riepe, 1046 Green Meadow Rd.; Stephen S. Riepe, 5219 Monroe Ave., both of Evansville, Ind. 47715

[21] Appl. No.: 154,097

[22] Filed: Nov. 18, 1993

[51] Int. Cl.[5] ..... A63B 63/08; A63B 69/00

[52] U.S. Cl. ..... 273/1.5 A

[58] Field of Search ..... 273/1.5 R, 1.5 A, 400

[56] References Cited

U.S. PATENT DOCUMENTS 1,904,836 4/1933 Peoples ..... 273/1.5 R
2,708,576 5/1955 Verkiulen ..... 273/1.5 R
2,918,283 12/1959 Marschalk ..... 273/1.5 R
3,348,840 10/1967 Dix ..... 273/1.5 A

*Primary Examiner*—William H. Grieb
*Attorney, Agent, or Firm*—Addison E. Riepe; Stephen S. Riepe

[57] ABSTRACT

A basketball practice rim comprised of an annular rim with a plurality of approximately horizontally extended brackets of two types which is painted or otherwise colored differently than the larger in diameter basketball goal to which it can be easily mounted when desired during practice, or dismounted from during a regulation basketball game. The practice rim when used diligently will improve the accuracy and performance of a player of greater or lesser ability.

3 Claims, 2 Drawing Sheets

BASKETBALL SHOOTING ACCURACY PRACTICE RIM

Figure 1:
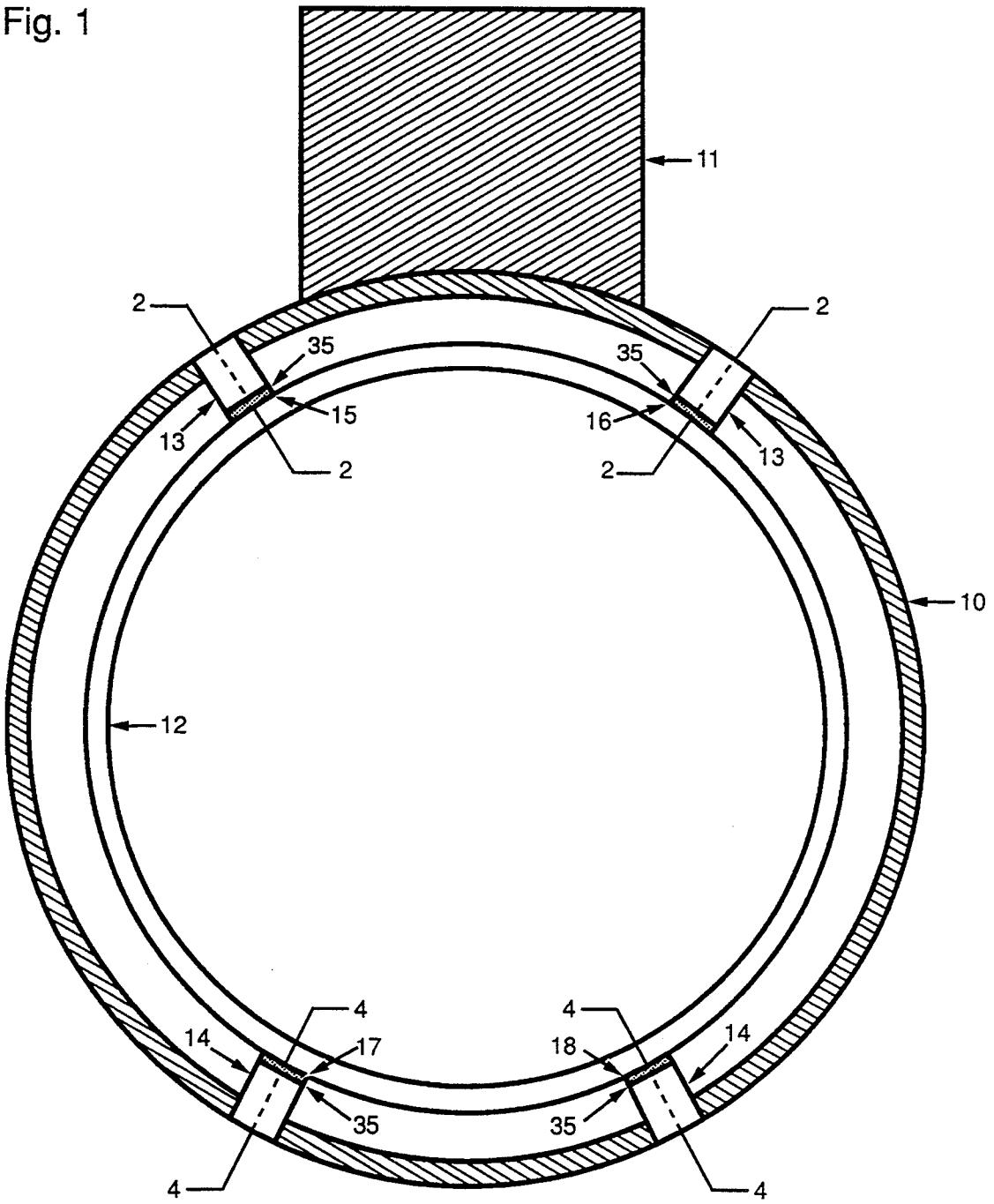

Our invention is a practice rim to be used during basketball practice by individuals or teams to practice both free throw shooting and field goal shooting by shooting at a target smaller in diameter than a standard basketball goal, but which easily mounts on and can be dismounted from the standard goal when desired.

Players devoting sufficient practice time to shooting a basketball at a goal equipped with our device will find that their shooting skills will be much improved when our rim is removed from the goal, since the standard basketball goal has a diameter substantially greater than our practice rim.

Other inventors have previously attempted designs to achieve the same end. U.S. Pat. No. 1,904,836 to Peoples Apr. 18, 1933 uses a total of 10 separate pieces including bolts, nuts, brackets and a ring to accomplish the purpose and would require tools and time to attach and loosen from the standard basketball goal. If any piece or pieces are lost, the integrity of the design is impaired. Our rim has only the rim itself with attached brackets plus two thumbscrews and attaches and detaches very quickly without tools.

U.S. Pat. No. 2,708,576 to Vetkuilen May 17, 1955 is basically a rebounding ring and is so designated in its title. It is designed to be approximately 1 inch above the standard basketball goal, requiring more of an alteration of the shooting arc than our rim, which rests only about $\frac{1}{4}$ inch above the goal. His rebound ring has only 3 support arms, one of which contains a thumbscrew at about a 45 degree angle to tighten against the goal. Our rim as shown in the drawings has 4 attached brackets, with 2 of them having thumbscrews at a 90 degree angle, more or less, to tighten against the goal, making it much more stable and making the screws much less likely to work loose after the constant pounding of the ball against the rim. Also, our clamps are rounded, while his are not. The constant pounding on his clamps would have a much greater tendency to damage the basketball. Our rim is designed as a shooting rim with rebounding a secondary consideration. Verkuilen is designed as a rebounding rim with shooting secondary.

U.S. Pat. No. 2,918,283 to Marschalk Dec. 22, 1959 uses the principle of a partially round C-shaped smaller ring within a larger basketball goal to attach itself, using a spring action to hold the plurality of legs against the goal to keep it in place. Like Verkuilen above, the Marschalk ring sits above the goal, resulting in an altered shooting arc. Since it is only held in place by the spring action contained within the device itself and since there are two ends, not a complete circle, a ball constantly impacting on it would be damaged by striking the ends and it would be very possible for it to spring loose and fall on anyone unlucky enough to be caught beneath it.

All of the above cited patents were issued when a standard basketball goal was merely a ring attached with braces to a backboard. The net was then fastened to the rim by tape or other means. Most, if not all, modern goals have a series of 12 pre-formed hangers spaced approximately equi-distant from each other around the underneath side of the goal and welded or otherwise attached thereto. The cords of the basket itself, having 12 loops, are made to be suspended from these hangers. Our rim has been developed and a model tested and will fit most, if not all, of the standard basketball goals being produced today. It is doubtful that the rings covered by the 3 patents previously cited would fit today's standard basketball goal. The dimensions cited below in this application may be changed, but when used as shown will, with reasonable tolerances, be found to enable the device to fit and be used as designed.

We respect the integrity of the above mentioned patents, but our conception incorporates the best way to achieve the objective of improving basketball shooting accuracy. The construction of our rim, with the rounding off of the brackets as shown will be less damaging to a basketball after constant use than any of the above mentioned designs. Our rim is designed to fit the current construction of basketball goals better than any of the others.

Our invention is unique as compared with others in that it provides a target within about $\frac{1}{4}$ inch of the standard height of 10 feet above the floor that the standard basketball goal is mounted. Nearly all standard goals are initially painted an orange or reddish orange color when shipped from the manufacturer. Our practice rim and its appendages should be painted a bright yellow or some other contrasting color so that the target is easily seen since it is only about $\frac{1}{4}$ inch above the goal.

Other further objects and advantages of our invention will become apparent from the attached drawings and accompanying descriptions of suggested construction, suggested dimensions, and explanation of the method of mounting on and dismounting off the Basketball Shooting Accuracy Practice Rim from the standard basketball goal.

The drawings are:

FIG. 1, which is a top view of our practice rim showing how it fits over the standard basketball goal.

Figure 2:
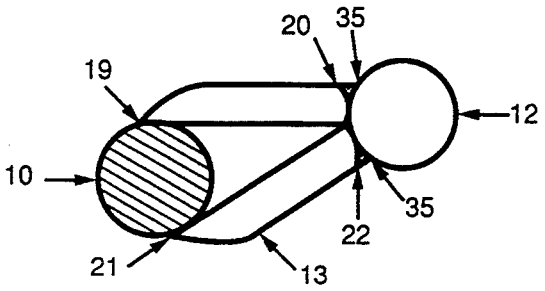

FIG. 2, which is an expanded side view of two of the brackets taken along the lines 2—2 of FIG. 1.

Figure 3:
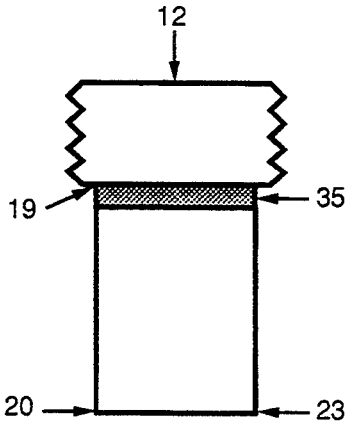

FIG. 3, which is a top view of the brackets shown in FIG. 2 and along the lines 2—2 of FIG. 1.

Figure 4:
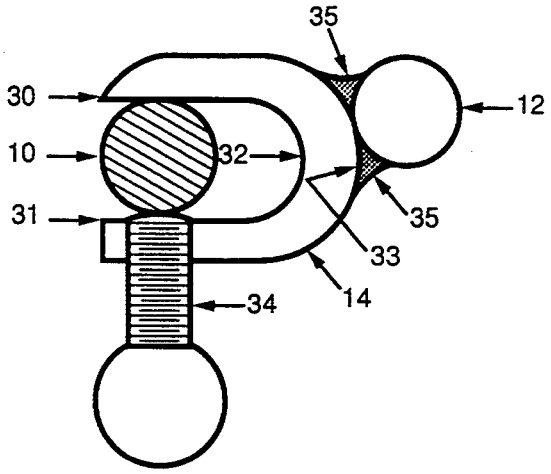

FIG. 4, which is an expanded side view of the remaining two brackets taken along the lines 4—4 of FIG. 1.

Figure 5:
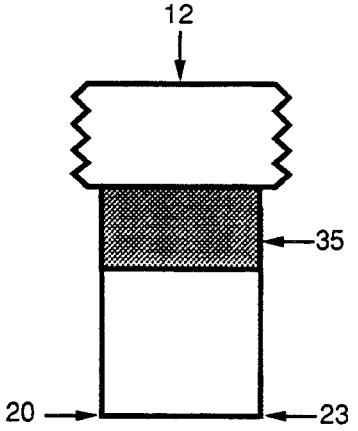

FIG. 5, which is a top view of the brackets shown in FIG. 4 and along the lines 4—4 of FIG. 1.

As shown on the drawings, in which like reference numerals designate the same part or area of a part throughout the several views thereof, there is shown in FIG. 1 a standard basketball goal 10, having an inside diameter of 18 inches, having affixed to the annular ring an angular bracket 11, by which it is secured to a backboard using bolts or other means.

Mounted on goal 10 is a practice rim 12, having attached brackets. One or more type 13 brackets are used and one or more of type 14 brackets are used. It is recommended that two of each type be used and that they be affixed to practice rim 12 by welding or other suitable means. It is recommended that the inside diameter of practice rim 12 be 15 inches and that the rim be made of $\frac{5}{8}$ inch diameter steel. All dimensions which follow presume this size, but if it is desired to increase or decrease the inside diameter of the rim or of the material of which it is constructed, the dimensions which follow must also be adjusted to reflect this fact.

The distance from point 15 to point 16 is 8 inches, more or less, as measured in a straight line. The distance from point 17 to point 18 is 6 inches, more or less, as measured in a straight line. These measurements enable the practice rim to fit most, if not all, current standard basketball goals.

The basic structure of both brackets 13 and 14 is suggested to be of $\frac{1}{4}$ inch by 1 inch steel bar stock which, when fabricated, is attached by welding or other means to rim 12. The distance from point 19 to point 20 and from point 21 to point 22 as shown in FIGS. 2 and/or 3 is $1\frac{1}{4}$ inches, more or less. The distance from point 19 to point 21 as shown in FIG. 2 is $\frac{3}{4}$ inch, more or less. The distance from point 20 to point 23, shown in FIGS. 3 and 5 is 1 inch, more or less. All top surfaces shown in FIGS. 2 and 4 are rounded as shown, including the top side corners, to decrease wear and tear on the basketball as it hits them in practice. The bottom surface of the bottom piece indicated in FIG. 2 is rounded as shown.

The type 14 brackets may be made by bending the suggested $\frac{1}{4}$ inch by 1 inch metal from which they could be made until the upper and lower portions form a "U" shape. The inside measurement of the bracket formed should be $\frac{3}{4}$ inch, more or less, as measured from point 30 to point 31, meaning the radius of point 32 should be $\frac{3}{8}$ inch, more or less. The distance from the midpoint of an imaginary line drawn from point 30 to point 31 and the furthest outside point of the type 14 bracket and indicated as point 33 should be $1\frac{1}{2}$ inches, more or less. The bottom arm of the bracket is tapped at approximately the point shown to receive a $\frac{3}{8}$ inch-16$\times\frac{3}{4}$ inch thumbscrew or other appropriate size and type screw or device as shown by point 34. All points designated as point 35 on FIGS. 1, 2, 3, 4, and 5 are points at which both types of bracket, 13 and 14, are welded or otherwise attached to rim 12.

When it is desired to attach the practice rim assembly 12 to the standard basketball goal 10, the following steps are taken:

1. Back off both thumbscrews shown as 34 on the type 14 brackets until the full $\frac{3}{4}$ inch opening is exposed.
2. Slide both type 14 brackets over the front of the standard basketball goal 10 as far as they will go, with the thumbscrew 34 on the bottom side.
3. With both type 14 brackets in place over the front of goal 10, slide both type 13 brackets in place as far as they will go, over the back of goal 10.
4. Tighten both thumbscrews finger tight. The rim 12 should now be attached tightly to the goal 10, and ready for use.

When it is desired to remove rim 12 from goal 10, reverse the above procedure.

From the discussion outlined above of the theory of our invention, its construction, and the way it can be easily put on or taken off of a standard basketball goal, it is readily apparent that our Basketball Shooting Accuracy Practice Rim meets a real need for the game of basketball.

We do not imply that our device can make every individual player a great shooter, since there are physical differences in humans and all are endowed with different levels of talent. It is a fact, however, that the more diligently one practices using the practice rim, the more that person can realize the greatest natural potential with which he or she has been born. It is good for assisting one's accuracy in free throw shooting and all ranges of field goal shooting. There is nothing to prevent it being used not only for shooting practice, but also in practice games.

As many changes could be made in the materials specified in the assemblies shown on the drawings, as well as methods of fastening the various parts together, and as different dimensions may be used other than those illustrated, it is intended that all matter contained in the drawings and descriptions be interpreted as illustrative and not in a limiting sense.

We claim:

1. A practice device composed of an annular rim smaller than a basketball goal with a plurality of outwardly extending brackets of one or more types which can be mounted on said basketball goal for practice and dismounted for an actual game, said brackets comprising:

(a) a first type of bracket being composed of a top of a certain length and a bottom extending at an angle beneath said top so as to enable said bracket to be attached to said rim so as to fit snugly against said basketball goal, and (b) a second type of bracket being formed of at least one piece, being so constructed that the top portion extends from said rim and being so formed that the bottom portion of said bracket is of a length permitting it to have a means suitable for accepting a type of fastener enabling said bracket to be slipped over the front of said basketball goal prior to snugging up said first type of bracket described in (a) above, and when said first type of bracket is in its proper position, said fastener on said second type of bracket should be tightened to hold said annular rim in a secure and tight position to said basketball goal.

2. The practice device of claim 1, wherein said bracket described in claim 1 (a), is composed of a top piece fastened to said rim and which extends from said rim; and a bottom piece fastened to said rim and which extends at an angle from said rim.

3. The practice device of claim 1, wherein said bracket described in claim 1 (a), is composed of a single piece of material bent at such an angle so as to form the required bracket, and which is fastened to said rim.

* * * * *